US008622722B2

(12) United States Patent
Li et al.

(10) Patent No.: US 8,622,722 B2
(45) Date of Patent: Jan. 7, 2014

(54) FUEL PUMP

(75) Inventors: Yong Bin Li, Hong Kong (CN); Wei Feng Yuan, Hong Kong (CN); Ning Sun, Shenzhen (CN); Xin Ping Wang, Shenzen (CN)

(73) Assignee: Johnson Electric S.A., La Chaux-de-Fonds (CH)

( * ) Notice: Subject to any disclaimer, the term of this patent is extended or adjusted under 35 U.S.C. 154(b) by 293 days.

(21) Appl. No.: 12/553,591

(22) Filed: Sep. 3, 2009

(65) Prior Publication Data

US 2010/0054972 A1 Mar. 4, 2010

(30) Foreign Application Priority Data

Sep. 3, 2008 (CN) ..... 2008 1 0141851

(51) Int. Cl.
*F04B 35/04* (2006.01)

(52) U.S. Cl.
USPC ... 417/423.7; 417/366; 310/54; 310/216.072; 310/216.073; 310/216.055; 310/216.056

(58) Field of Classification Search
USPC ..... 417/366, 423.3, 423.7; 310/54, 43, 310/216.055, 216.056, 216.073, 216.072, 310/216.136
IPC ..... H02K 1/06,1/16, 1/26, 1/20, 1/32, H02K 1/04, 9/00, 9/02
See application file for complete search history.

(56) References Cited

U.S. PATENT DOCUMENTS 2,715,193 A * 8/1955 Staley ..... 310/216.136
2,761,078 A * 8/1956 McAdam ..... 310/67 R
2,975,311 A * 3/1961 Suhr ..... 310/172
4,672,253 A * 6/1987 Tajima et al. ..... 310/269
4,922,604 A * 5/1990 Marshall et al. ..... 29/598
5,418,416 A * 5/1995 Muller ..... 310/186
6,422,839 B1 * 7/2002 Brockner et al. ..... 417/423.7
6,879,079 B2 * 4/2005 Vollmer ..... 310/254.1

(Continued)

FOREIGN PATENT DOCUMENTS

JP 2002354766 A * 12/2002
JP 2006-101672 A 4/2006
JP 2010-063344 A 3/2010
WO WO 2007113436 A1 * 10/2007

OTHER PUBLICATIONS

Machine-Translation_JP-2002-354766-A (machine translation of JP-2002-354766-A).*

(Continued)

*Primary Examiner* — Devon Kramer
*Assistant Examiner* — Thomas Fink
(74) *Attorney, Agent, or Firm* — Muncy, Geissler, Olds & Lowe, PLLC

(57) ABSTRACT

A fuel pump, for an internal combustion engine, has a housing accommodating a pump and a motor. The motor is arranged to drive the pump so as to pump fuel through the housing. The motor has a wound stator having a plurality of inwardly directed teeth about which a stator winding is wound, and a radially outer surface in contact with an inner surface of the housing. One or more pathways are formed between the inner surface of the housing and the outer surface of the stator, for the flow of fuel there through. Each pathway is formed by an axially extending recess formed in the outer surface of the stator and aligned with a selected tooth of the stator.

14 Claims, 2 Drawing Sheets

(56) References Cited

U.S. PATENT DOCUMENTS

| | | | | |
|---|---|---|---|---|
| 7,019,422 | B2 * | 3/2006 | Neal et al. | 310/43 |
| 7,247,967 | B2 * | 7/2007 | Ionel et al. | 310/216.086 |
| 2003/0173925 | A1 * | 9/2003 | Strobl et al. | 318/543 |
| 2004/0062664 | A1 * | 4/2004 | Weigold et al. | 417/357 |
| 2006/0066159 | A1 | 3/2006 | Enomoto et al. | |
| 2007/0025866 | A1 * | 2/2007 | Douyama et al. | 417/423.3 |
| 2009/0174280 | A1 * | 7/2009 | Prudham | 310/216.022 |
| 2010/0034674 | A1 | 2/2010 | Oota et al. | |

OTHER PUBLICATIONS

Tooth-Ripple Losses in Unwound Pole-Shoes, W. J. Gibbs, Oct. 1946.*

Permanent-Magnet Brushless Machines With Unequal Tooth Widths and Similar Slot and Pole Numbers, Ishak et al., Apr. 2005.*

Design and predicting efficiency of highly nonlinear hollow cylinders switched reluctance motor, El-Kharashi, Jun. 2007.*

* cited by examiner

FUEL PUMP

CROSS REFERENCE TO RELATED APPLICATIONS

This non-provisional patent application claims priority under 35 U.S.C. §119(a) from Patent Application No. 200810141851.2 filed in The People's Republic of China on Sep. 3, 2008.

FIELD OF THE INVENTION

This invention relates to a fuel pump for an internal combustion engine and in particular to a fuel pump driven by a brushless direct current (BLDC) motor.

BACKGROUND OF THE INVENTION

Fuel pumps are used in motor vehicles to transfer liquid fuel, typically gasoline or diesel from a fuel tank to an internal combustion engine. The pump is driven by a small DC motor and to minimize fuel leakage through bearing seals etc, the fuel passes through the interior of the motor. This works very well even with motors having commutators, with the fuel cooling the motor and eliminating sparking between the brushes and the commutator. However, with the advent of high alcohol fuels, chemical reactions between the commutator and the fuel has become problematic leading to the use of graphite commutators and renewed interest in brushless motors to drive the fuel pumps. There are many advantages of brushless motors, especially in automobile applications, such as longer life by eliminating the use of brushes and a commutator.

One problem with the use of BLDC motors in fuel pumps is that the fuel has a very restricted pathway through the motor which causes a severe restriction to the free flow of fuel. One reason for this is that BLDC motors have a wound stator and due to the aggressive nature of the fuel it is desirable to protect the stator windings. This is usually done by over moulding the stator, core and windings, with over mould material such as a plastics material or a resinous material, preferably using an insert moulding technique. This technique, unfortunately, transforms the stator into a solid mass, closing off the various gaps between the stator core and the windings. As the stator core is usually pressed into the pump housing, the only remaining pathway for the fuel is through the small gap between the stator and the rotor. However, this gap is intentionally made as small as possible to increase the efficiency of the motor. Fuel in this small gap is caught between the rotating rotor on one side and the stationary stator on the other side causing frictional heating of the fuel as well as causing considerable drag on the rotor, resulting in a significant lowering of the motor efficiency. This problem does not exist in the PMDC motors having a stator formed with segment magnets due to the channels existing between the individual magnets.

The term brushless direct current motor is used in this specification is used in its widest sense and is intended to include those special BLDC motors known as BLAC motors which have a similar physical structure but are designed to operate with sinusoidal power signals from the motor controller.

SUMMARY OF THE INVENTION

Hence there is a desire for a BLDC motor driven fuel pump which does not restrict the flow of fuel passed the motor while maintaining the efficiency of the motor.

This is achieved in the present invention by fuel passageways between the motor stator and the fuel pump housing.

Accordingly, in one aspect thereof, the present invention provides a fuel pump for an internal combustion engine, comprising: a housing; a pump accommodated within the housing; a motor accommodated within the housing, the motor having a wound stator having a plurality of inwardly directed teeth about which a stator winding is wound, and an outer surface in contact with an inner surface of the housing; and at least one pathway formed between the inner surface of the housing and the outer surface of the stator, for the flow of fuel there through.

Preferably, the or each pathway is formed by an axially extending trough formed in the outer surface of the stator.

Preferably, the or each trough is aligned with a selected tooth of the stator.

Preferably, the or each selected tooth of the stator is unwound.

Preferably, the stator is over molded with material to protect the winding from chemical reaction with the fuel.

Preferably, the motor is a brushless direct current motor.

Preferably, the stator of the motor is encased in a plastics or resin material.

Preferably, there are three pathways and the motor has four rotor poles and nine stator poles.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labelled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
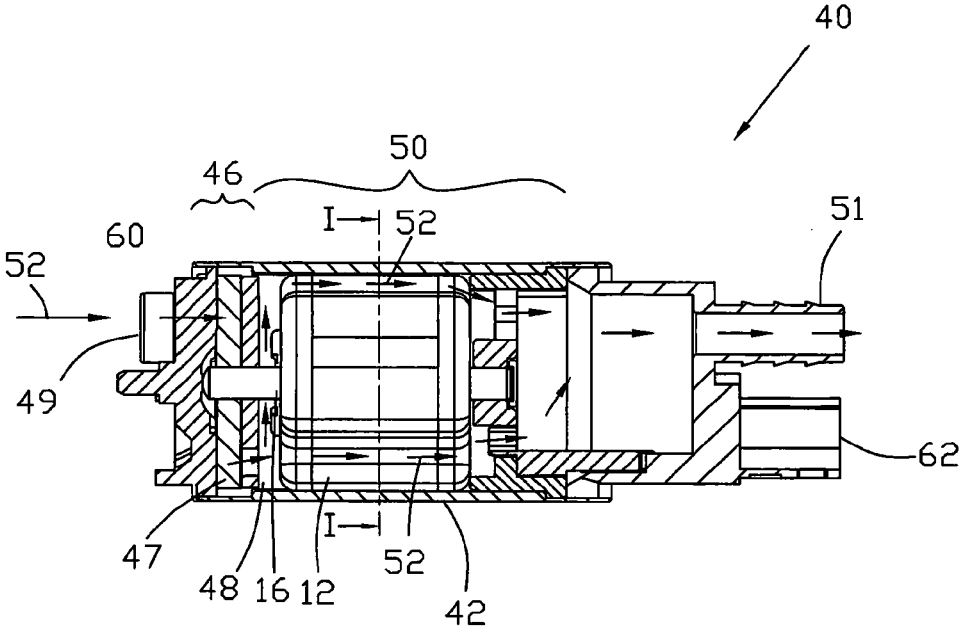
FIG. 1 is a sectional view of a fuel pump, according to a preferred embodiment of the present invention.

FIG. 1 illustrates a complete fuel pump 40 in sectional view. The fuel pump has a housing 42 of cylindrical form with two open ends which are sealed by end caps 44, 45 which connect the fuel pump to the fuel lines. The housing has a pump section 46 and a motor section 50 accommodating a motor. The pump section 46 includes an impeller 47 arranged to be rotated by the motor within a volute 48 to draw fuel into the pump section from a fuel inlet 49 in the first end cap 44 and force the fuel through the motor section 50 and out a fuel outlet 51 in the second end cap 45. The motor section 50 houses the motor which includes a stator 12 which is pressed into the housing 42, and the rotor 16 with the rotor core 17 located within the stator 12 and a rotor shaft 19 which is journalled in bearings in the pump volute 48 at one end and in the second end cap 45 at the other end. The stator 12 supports a stator winding 20 and is over molded with material, such as a plastics material or a resin material, to protect the winding from chemical reaction with the fuel being pumped. The second end cap is shown being of two parts, a first part sealing the housing 42 and forming the fuel outlet 51 and the connector for the electrical power to operate the motor, and a second part supporting the bearing for the rotor shaft. The second end cap 45 may include an electronics module to accommodate the electronics for operating the BLDC motor. However, in this embodiment the electronics module is provided outside of the fuel pump.

The fuel flow path through the fuel pump is: in through the inlet 49 in the first end cap 44; into the pump volute 48, where it is forced out by the impeller 47 into the interior of the housing 42; passed the motor by passing through the fuel pathways 52 between the stator core 13 and the housing 42 (although some fuel may still pass between the rotor core 17 and the stator core 13); into the second end cap 45; and out of the pump though the fuel outlet 51 of the second end cap 45, as illustrated by block arrows 60.

Figure 2:
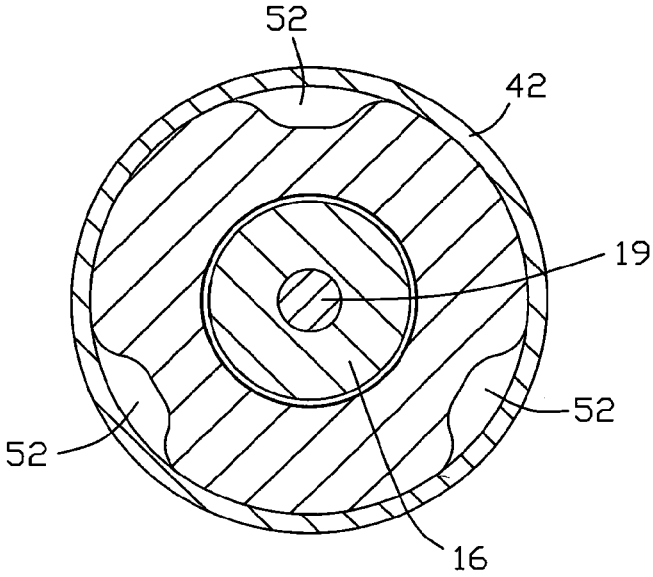
FIG. 2 is a cross-sectional view of the fuel pump of FIG. 1 viewed along lines A-A.

FIG. 2 is a transverse sectional view through the fuel pump, viewed along section lines A-A of FIG. 1. FIG. 2 illustrates the fuel pathways 52 between the stator 12 and the housing 42. Three fuel pathways 52 are provided in the preferred embodiment. FIG. 2 also shows how the gaps 130 (as shown in FIG. 4) in the stator have been filled by the over mould material such that the end face of the stator presents as a solid wall.

Figure 3:
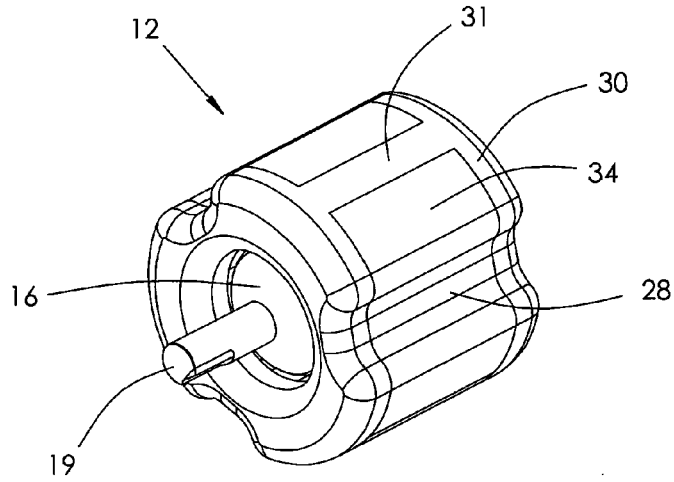
FIG. 3 is a perspective view of a motor of the fuel pump of FIG. 1.

The stator 12 and rotor 16 set is illustrated in FIG. 3. After the stator winding is formed on the stator core 13, the stator 12 is over molded with a plastics material or resin material 30, preferably by an insert molding operation. Preferably, the pole faces 18 and the radially outer surface 34 of the stator core 13 are not covered with the over mould material. This ensures a good transfer of magnetic flux between the pole faces 18 of the stator and the rotor and also allows a good fit with the motor housing in which the stator core is preferably a press fit.

The stator winding may be connected to stator terminals for connection to a controller or directly to motor terminals and where used the terminals would also have exposed parts (not shown) not covered by the over molding for making further electrical connections. The rotor core 17 is also shown as being over molded to protect the rotor core from the fuel and to assist retention of the magnets on the rotor. The over mould material also helps the efficiency of the fuel pump by making a smooth path for the flow of the fuel and by smoothing the outer surface of the rotor to reduce windage, the resistance created by rotating body.

Figure 4:
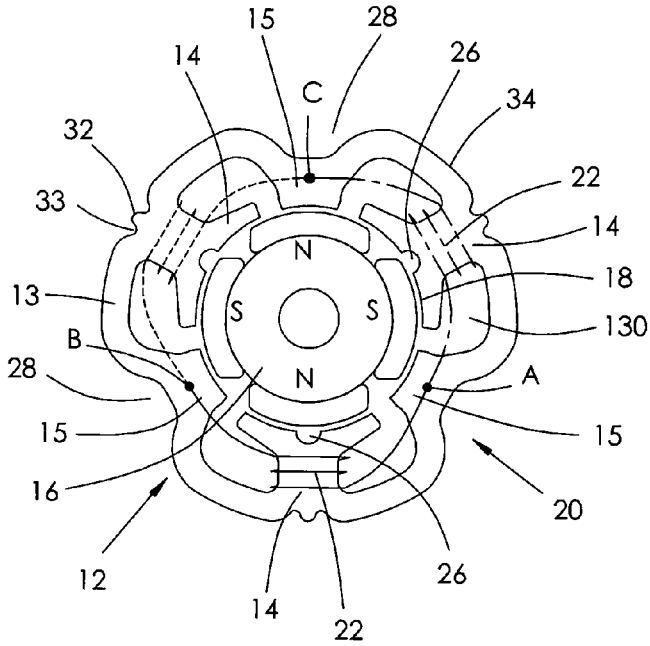
FIG. 4 is a schematic diagram of a stator core and rotor for the motor of FIG. 3.

FIG. 4 is a schematic winding diagram for a 3-phase BLDC motor for a first preferred embodiment. FIG. 4 also illustrates the configuration of the stator core of the preferred embodiment. The stator 12 has a stator core 13 with six teeth 14, 15 forming the stator poles as will be described later. The winding 20 has only three coils 22 formed about alternate teeth 14. The winding 20 is a 3-phase Delta winding having three legs, one leg for each phase, with each end of each leg being connected to two of the three stator terminals A,B,C, with each terminal being connected to two of the legs, such that the ends of each leg is electrically connected to the other two legs. Thus each leg has only one coil 22. However, the wound teeth 14 have a larger circumferential extent than the unwound teeth 15 and have a deep groove 26 in the pole face which extends axially for the length of the tooth 14 and radially outwardly into the tooth, dividing the pole face into two, preferably equal, portions. The groove 26 has the effect of dividing the tooth 14 into two stator poles and forming a dummy slot. Thus the stator effectively has 9 slots or 9 stator poles. The grooves 26 are referred to as dummy slots as no coils are wound into the dummy slots, giving the stator a simple winding.

Indeed, a Delta winding configuration does offer some advantages by simplifying the winding connections as shown in FIG. 4. As shown, in the Delta configuration of a three phase winding, each phase winding is connected to the other two phase windings. Thus, during winding the wire is connected to a first stator terminal A, wrapped about a first stator tooth to form the first phase winding, connected to a second stator terminal B, wrapped about a second stator tooth to form the second phase winding, connected to a third stator terminal C, wound about a third stator tooth to form the third phase winding and finally connected back to the first stator terminal A. The wire is only cut after being connected to the first stator terminal for the second time, simplifying the winding by eliminating the common Star connection point.

FIG. 4 also shows the shape of the stator core. The stator core 13 has a circular construction to mate with the inner surface of the housing 42 of the fuel pump, with the exception that the radially outer surface 34 of the stator core 13 has a number of axially extending recesses 28. Recesses 28 form fuel pathways between the stator core 13 and the housing 42 allowing the fuel to flow through passed the motor. The recesses 28 are shown aligned with the non-wound teeth 15. This is thought to have no negative impact on the magnetic circuit of the stator while allowing maximum space for the coils 22 formed on the wound teeth 14.

The stator core 13 is a laminated structure formed by stamping and stacking a plurality of steel laminations. The laminations may be held together by suitable means such as interlocking or welding. In the preferred embodiment the laminations are welded together. This is preferably done by using a laser welder to weld together a small nub 32 formed on each lamination for this purpose in a cut-out 33 in the outer surface 34 of the stator core aligned with the wound teeth 14, as shown in FIG. 4. During over molding, this cut-out 33 is filled with mould material to protect the weld. This over mould material forms the strip 31, which can be seen in FIG. 3 on the outer surface 34 of the stator core connecting the ends of the stator.

Thus the present invention provides a novel construction for a fuel pump. This structure is well suited to use of a BLDC motor in the pump for driving the pump. For the fuel pump, the provision of fuel pathways between the stator and the housing is considered an advantage. The use of a BLDC motor, especially a BLDC motor with reduced cogging torque is an added advantage. Certain embodiments are ideally suited to mass production.

While the housing of the fuel pump has been described as 'cylindrical' and the example shown is a right circular cylinder, it is intended that this term is not limited to a cylinder with a right circular cross-section but covers any tubular structure having a constant cross-section, with ends which may or may not be formed perpendicular to the longitudinal axis of the cylinder.

Although the invention is described with reference to one or more preferred embodiments, it should be appreciated by those skilled in the art that various modifications are possible. Therefore, the scope of the invention is to be determined by reference to the claims that follow.

In the description and claims of the present application, each of the verbs "comprise", "include", "contain" and "have", and variations thereof, are used in an inclusive sense, to specify the presence of the stated item but not to exclude the presence of additional items.

The invention claimed is:

1. A fuel pump for an internal combustion engine, comprising:

a housing;

a pump accommodated within the housing;

a motor accommodated within the housing, the motor comprising a wound stator having a plurality of inwardly directed teeth about which a stator winding is wound and at least one unwound tooth, and an outer surface in contact with an inner surface of the housing; and at least one pathway formed between the inner surface of the housing and the outer surface of the stator, for the flow of fuel there through, each pathway being formed by a recess formed in the outer surface of the stator, and the recess substantially extending in an axial direction of the motor, each recess being aligned with an unwound tooth of the stator, wherein the stator is over moulded with material, the material encases the stator winding to protect the stator winding from chemical reaction with the fuel, pole pieces of the stator are not covered by the material, and wherein a core of the stator comprises a plurality of laminations stacked together, each lamination defines a plurality of spaced cutouts in an outer circumference and forms a nub in each of the cutouts, the cutouts of the laminations are aligned axially, the nubs of the laminations are welded together to connect the laminations together, the material is filled in the cutouts to form a plurality of spaced strips to protect the weld, portions of the outer circumferences of the laminations between adjacent strips being not covered by the material.

2. A fuel pump for an internal combustion engine, comprising:

a housing with an inlet and an outlet respectively defined in two opposite ends thereof for fuel to flow in and out of the housing;

a pump accommodated in the housing;

a motor accommodated in the housing for driving the pump, the motor comprising:

a rotor having a shaft and an armature fixed to the shaft;

a stator surrounding and facing the rotor, the stator comprising a core with a plurality of first teeth and a same plurality of second teeth, both the first teeth and the second teeth extending inwardly, and a winding wound on the first teeth of the core, the second teeth being unwound, the stator being received in the housing with a first portion of a radially outer surface of the stator mating with and contacting an inner surface of the housing;

wherein at least one pathway is defined between the inner surface of the housing and another portion of the radially outer surface of the stator, the pathway extending from one end to an opposite end of the stator for the fuel flowing through the motor, each pathway being aligned with a respective one of the second teeth;

wherein the stator is over moulded with material, the material encases the stator winding to protect the stator winding from chemical reaction with the fuel, pole pieces of the stator are not covered by the material;

wherein the core of stator comprise a plurality of laminations stacked together, each lamination defines a cutout in an outer circumference and forms a nub in the cutout, the cutouts of the laminations are aligned axially, the nubs of the laminations are welded together to connect the laminations together, the material is filled in the cutouts to protect the weld; and wherein each of the first teeth has at least one axially extending groove formed in an inner face thereof to divide each said tooth into multiple stator poles, the number of stator poles formed by the first teeth being greater than the number of stator poles formed by the second teeth.

3. The fuel pump of claim 1, wherein the stator defines a plurality of winding slots between the teeth to receive the winding, the pathway at least partially overlaps one of the winding slots in a radial direction of the stator.

4. The fuel pump of claim 1, wherein the stator defines a plurality of winding slots between the teeth to receive the winding, a radially innermost boundary of the pathway is located closer to a central axis of the stator than a radially outermost boundary of the winding slot.

5. The fuel pump of claim 1, wherein the cutout of the lamination is aligned with a wound tooth.

6. The fuel pump of claim 2, wherein the stator defines a plurality of winding slots between the first teeth and the second teeth to receive the winding, the pathway at least partially overlaps one of the winding slots in a radial direction of the stator.

7. The fuel pump of claim 2, wherein the stator defines a plurality of winding slots between the first teeth and the second teeth to receive the winding, a radially innermost boundary of the pathway is located closer to a central axis of the stator than a radially outermost boundary of the winding slot.

8. The fuel pump of claim 2, wherein the cutout of the lamination is aligned with a wound tooth.

9. A fuel pump for an internal combustion engine, comprising:

a housing;

a pump accommodated in the housing;

a motor accommodated in the housing and arranged to drive the pump, the motor comprising:

a rotor;

a stator surrounding and facing the rotor, the stator comprising a core having a plurality of inwardly directed teeth, a winding wound on the teeth of the core, and an outer surface in contact with an inner surface of the housing; and at least one pathway defined between the inner surface of the housing and the outer surface of the stator, each pathway extending from one axial end to an opposite axial end of the stator;

wherein the stator is over moulded with material, the material encases the winding to protect the winding from chemical reaction with fuel; and wherein the core of the stator comprises a plurality of laminations stacked together, each lamination defines a cutout in an outer circumference and forms a nub in the cutout, the cutouts of the laminations are aligned axially, the nubs of the laminations are welded together to connect the laminations together, the material is filled in the cutouts to protect the weld;

wherein each pathway is in the form of a recess formed in the outer surface of the stator, and wherein the rotor has four permanent magnet rotor poles, and the stator has six stator teeth, three of the six stator teeth each having one axially extending groove formed in an inner face thereof to divide each said tooth into two stator poles such that the stator forms nine stator poles.

10. The fuel pump of claim 9, wherein the stator comprises at least one unwound tooth, each pathway is aligned with a respective unwound tooth.

11. The fuel pump of claim 10, wherein the stator defines a plurality of winding slots between the teeth to receive the winding, each pathway at least partially overlaps a respective one of the winding slots in a radial direction of the stator.

12. The fuel pump of claim 10, wherein the stator defines a plurality of winding slots between the teeth to receive the winding, a radially innermost boundary of the pathway is located closer to a central axis of the stator than a radially outermost boundary of the winding slots.

13. The fuel pump of claim 9, wherein each lamination defines a plurality of cutouts in the outer circumference, the material being filled in the cutouts to form a plurality of spaced strips to protect the weld, each of the cutouts being radially aligned with a corresponding one of the teeth, the cutouts and the recesses being arranged alternately in a circumferential direction of the stator.

14. The fuel pump of claim 2, wherein the rotor has four permanent magnet rotor poles, and the stator has three first teeth and three second teeth, each of the first teeth having one axially extending groove formed in an inner face thereof to divide each said tooth into two stator poles such that the stator forms nine stator poles.

* * * * *